US007482981B2

(12) United States Patent
Goldberg et al.

(10) Patent No.: US 7,482,981 B2
(45) Date of Patent: Jan. 27, 2009

(54) CORONA WIND ANTENNAS AND RELATED METHODS

(75) Inventors: Steven Jeffrey Goldberg, Downingtown, PA (US); Bing A. Chiang, Melbourne, FL (US)

(73) Assignee: InterDigital Technology Corporation, Wilmington, DE (US)

( * ) Notice: Subject to any disclaimer, the term of this patent is extended or adjusted under 35 U.S.C. 154(b) by 197 days.

(21) Appl. No.: 11/191,315

(22) Filed: Jul. 28, 2005

(65) Prior Publication Data

US 2006/0022877 A1 Feb. 2, 2006

Related U.S. Application Data

(60) Provisional application No. 60/592,331, filed on Jul. 29, 2004, provisional application No. 60/615,866, filed on Oct. 5, 2004.

(51) Int. Cl.
*H01Q 1/26* (2006.01)

(52) U.S. Cl. ..... 343/701; 343/702

(58) Field of Classification Search ..... 343/701, 343/702

See application file for complete search history.

(56) References Cited

U.S. PATENT DOCUMENTS

| | | | | | |
|---|---|---|---|---|---|
| 2,760,055 | A | * | 8/1956 | Laster, Jr. | 343/907 |
| 3,404,403 | A | * | 10/1968 | Shostak et al. | 343/700 R |
| 3,846,799 | A | | 11/1974 | Gueguen | 343/833 |
| 3,914,766 | A | | 10/1975 | Moore | 343/701 |
| 5,905,473 | A | | 5/1999 | Taenzer | 343/834 |
| 5,990,837 | A | | 11/1999 | Norris et al. | 343/701 |
| 6,492,951 | B1 | | 12/2002 | Harris et al. | 343/701 |
| 6,674,970 | B1 | | 1/2004 | Anderson | 398/121 |
| 6,710,746 | B1 | | 3/2004 | Anderson et al. | 343/701 |
| 6,876,331 | B2 | | 4/2005 | Chiang et al. | 343/702 |

OTHER PUBLICATIONS

Ohira et al., Electronically Steerable Passive Array Radiator Antennas for Low-Cost Analog Adaptive Beamforming, 0-7803-6345-0/00, 2000, IEEE.

Scott et al., Diversity Gain From a Single-Port Adaptive Antenna Using Switched Parasitic Elements Illustrated with a Wire and Monopole Prototype, IEEE Transactions on Antennas and Propagation, vol. 47, No. 6, Jun. 1999.

King, The Theory of Linear Antennas, pp. 622-637, Harvard University Press, Cambridge, Mass., 1956.

Lo et al., Antenna Handbook: Theory, Applications and Design, pp. 21-38, Van Nostrand Reinhold Co., New York, 1988.

Johnson, Nano Work Chases Self-Cooled Chips, EE Time, Mar. 29, 2004.

* cited by examiner

*Primary Examiner*—Michael C Wimer
(74) *Attorney, Agent, or Firm*—Allen, Dyer, Doppelt, Milbrath & Gilchrist, P.A.

(57) ABSTRACT

A communications device includes a housing, an ionized air stream generator carried by the housing for generating an ionized air stream, and an ionized air chamber carried by the housing for directing the ionized air stream external the housing to function as an antenna. A transceiver is carried by the housing and is coupled to the ionized air chamber. The transceiver excites or detects changes in a current flow in the ionized air stream at radio communication frequencies.

37 Claims, 5 Drawing Sheets

CORONA WIND ANTENNAS AND RELATED METHODS

RELATED APPLICATION

This application claims the benefit of U.S. Provisional Application Ser. Nos. 60/592,331 filed Jul. 29, 2004 and 60/615,866 filed Oct. 5, 2004, the entire contents of which are incorporated herein by reference.

FIELD OF THE INVENTION

The present invention relates to the field of wireless communications, and more particularly, to a corona wind antenna for a wireless communications device.

BACKGROUND OF THE INVENTION

In wireless communication systems in which portable or mobile communication devices communicate with a base station or access point, such as a CDMA2000, GSM and WLAN communication system, the mobile communication device is typically a hand-held device, such as a cellular telephone, for example. The communication devices are provided with wireless data and/or voice services and can connect devices such as, for example, laptop computers, personal data assistants (PDAs), cellular telephones or the like through the base station or access point to a network.

Each communication device is equipped with an antenna. In some antenna embodiments, the antenna protrudes from the housing or enclosure of the communication device to improve antenna performance by adequately separating it from the electronic components carried by the housing. The protruding antenna may be a monopole or dipole antenna, for example.

Another type of antenna used with communication devices is a switched beam antenna. A switched beam antenna system generates a plurality of antenna beams including an omni-directional antenna beam and one or more directional antenna beams. Directional antenna beams provide higher antenna gains for advantageously increasing the communications range between the base station and the communication device, and for also increasing network throughput. A switched beam antenna is also known as a smart antenna or an adaptive antenna array.

U.S. Pat. No. 6,876,331 discloses a smart antenna for a mobile communication device. This patent is assigned to the current assignee of the present invention, and is incorporated herein by reference in its entirety. In particular, the smart antenna includes an active antenna element and a plurality of passive antenna elements protruding from the housing of the mobile communication device.

The physical length of an antenna, including the length of the active and passive antenna elements, is normally a minimum of a quarter wavelength of the operating frequency. Cellular telephones commonly operate in the 1.9 GHz range, which corresponds to an antenna length of about 1.6 inches. Protrusion of the various types of antennas from the housing of a cellular telephone may be broken or damaged when carried by a user. Even minor damage to a protruding antenna can significantly change its operating characteristics. In addition, lengthy protrusions take away from the appearance of a cellular telephone. Even for fixed devices, such as access points, protruding antennas can restrict their placement because of physical or esthetic reasons.

One approach to this problem is to have an antenna that is pulled out or extended by the user when in use. When not in use, the antenna is recessed within the mobile communication device. There are several problems with this approach. First, the user needs to extend the antenna for best performance, which is not always done. If the antenna is pulled out with excessive force, this may also lead to breakage, as well as if the user holds the mobile communication device by the extended antenna. For multi-frequency communication devices (e.g., 800 MHz and 1.9 GHz), the optimum length of the antenna varies depending on the operating frequency.

Another approach for an external antenna that is not easily damaged is based upon generation of an ionized air stream, i.e., a plasma antenna. U.S. Pat. No. 6,674,970 discloses a plasma antenna that includes a laser that emits a laser beam from an output aperture that travels along a vertical axis into the atmosphere. The laser beam interacts with a medium above it to form an unbounded plasma column. The plasma column comprises ions and electrons that produce an upward current in response to an abrupt ionization of the air in the column. A drawback of the '970 patent is that the ionized air needs to be in an enclosure, and requires generation equipment beyond what would be practical in a mobile communication device, such as a cellular telephone.

SUMMARY OF THE INVENTION

In view of the foregoing background, it is therefore an object of the present invention to provide an external antenna that is compatible with mobile communication devices and is not susceptible to being broken or damaged.

This and other objects, features, and advantages in accordance with the present invention are provided by a communications device comprising a housing, at least one ionized air stream generator carried by the housing for generating at least one ionized air stream, and at least one ionized air chamber carried by the housing for directing the at least one ionized air stream external the housing to function as an antenna. A transceiver is carried by the housing and is coupled to the at least one ionized air chamber. The transceiver excites or detects changes in a current flow in the at least one ionized air stream at radio communication frequencies.

The communications device may further comprise a modulator and a demodulator carried by the housing between the at least one ionized air chamber and the transceiver. The transceiver may be capacitively and/or inductively coupled to the at least one ionized air chamber.

The ionized air stream generator may comprise an ion generator for generating ions, and a pumping region adjacent the ion generator for generating the ionized air stream using the generated ions.

The ionized air chamber has an exposed end for directing the ionized air stream external the housing. The communications device may further comprise an antenna tube extension carried by the housing and is slideably positioned to an extended position along the exposed end of the ionized air chamber for extending a length of the antenna. The antenna tube extension may be moved to the extended position by the ionized air stream or by the user.

The at least one ionized air chamber may comprise a plurality of ionized air chambers, with each ionized air chamber directing a respective ionized air stream external the housing for functioning as an antenna. The respective ionized air streams may be directed external the housing in different directions to provide polarization diversity. Alternatively, the respective ionized air streams may be directed external the housing in the same direction to provide spatial diversity. At least one flow switch may be in a path of at least one of the plurality of ionized air chambers for restricting flow of the ionized air stream to a desired ionized air chamber.

The communications device may further comprise a conductive plate carried by the housing along an outer edge thereof and is laterally spaced away from an exit point of the ionized air stream. The conductive plate has a polarity opposite a polarity of the ionized air stream for causing the ionized air stream to loop back to the conductive plate. The conductive plate may be electrically connected to the ionized air stream generator.

In other embodiments, the at least one ionized air stream generator comprises a plurality of ionized air stream generators. Consequently, the at least one ionized air chamber comprises a respective ionized air chamber for each ionized stream generator. The communications device may further comprise a secondary ionized air stream generator carried by the housing for generating a secondary ionized air stream. The secondary ionized air chamber carried by the housing receives the secondary ionized air stream to function as a ground plane.

Another aspect of the present invention is directed to a method for generating an antenna for a communications device comprising a housing, at least one ionized air stream generator carried by the housing, and at least one ionized air chamber carried by the housing. The method comprises generating at least one ionized air stream by the at least one ionized air stream generator, and directing through the at least one ionized air chamber the at least one ionized air stream so that it is external the housing to function as an antenna.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and double prime notations are used to indicate similar elements in alternative embodiments.

Figure 1:
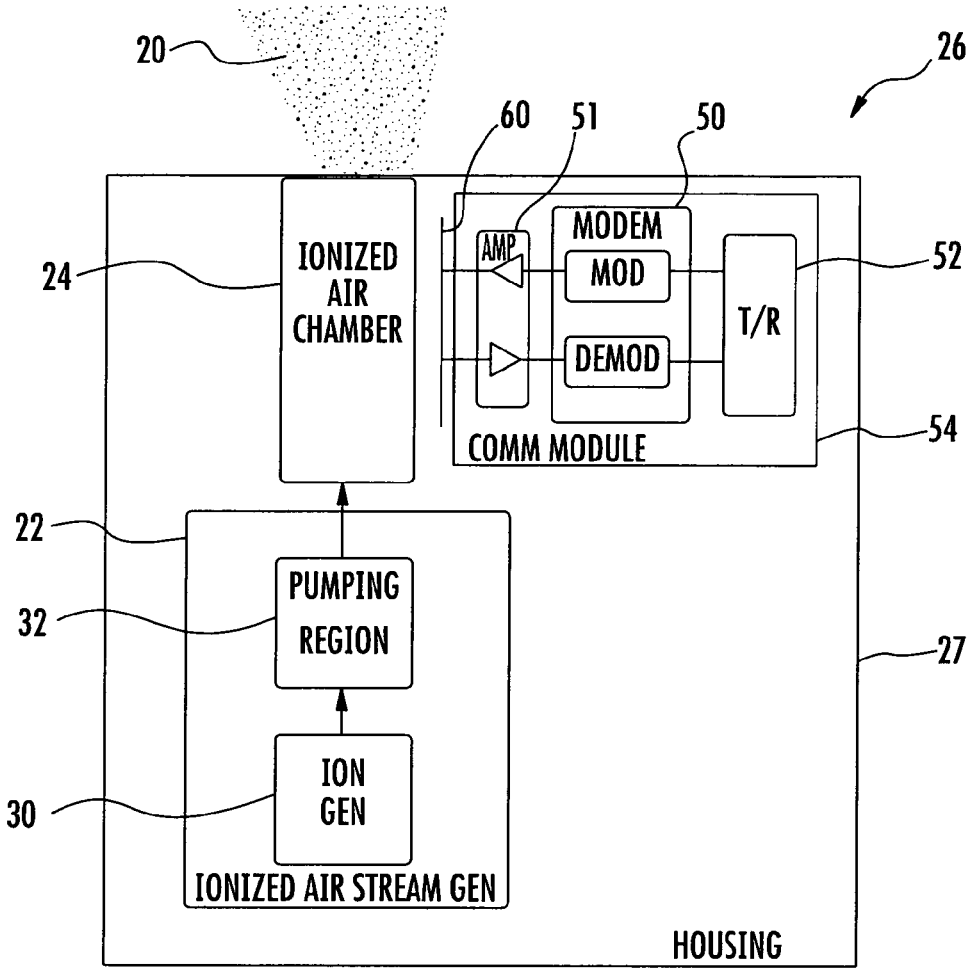
FIG. 1 is a block diagram of a mobile communications device with a corona wind antenna in accordance with the present invention.

Referring initially to FIG. 1, a corona wind antenna 20 in accordance with the present invention is generated by an ionized air stream generator 22 and an ionized air chamber 24 connected thereto. The ionized air stream generator 22 generates an ionized air stream, and the ionized air chamber 24 directs the ionized air stream into the ambient air to function as the antenna.

The corona wind antenna 20 provides for reception and transmission of radio communication signals with a base station in the case of a cellular telephone, or from an access point in the case of a wireless data unit by making use of wireless local area network (WLAN) protocols. For purposes of illustrating the present invention, the corona wind antenna 20 is incorporated into a mobile communications device 26, as illustrated in FIG. 1.

The mobile communications device 26 may be, but is not limited to, a cellular telephone, a personal data assistant (PDA), a laptop computer or a messaging device, for example. The corona wind antenna 20 may also be utilized by stationary communications devices, including access points or desktop computers, for example.

The corona wind antenna 20 is based upon ionized air generation techniques developed by researchers at Purdue University. An ionized air stream is used to produce corona winds, and the researchers at Purdue University use the corona winds to flow over a computer chip to remove heat from the chip. This technique works by generating ions, i.e., electrically charged atoms, using electrodes placed close to one another on the computer chip. Negatively charged electrodes, i.e., cathodes, are made of nanotubes of carbon.

Voltage is passed into the electrodes, causing the negatively charged nanotubes to discharge electrons toward the positively charged electrodes. The electrons react with the surrounding air, causing the air molecules to be ionized, just as electrons in the atmosphere ionize air in clouds. The ionization of air leads to an imbalance of charges that eventually results in lightning bolts. The ionized air molecules cause currents like those created by the corona wind phenomenon, which happens between electrodes at voltages higher than 10 kV. The researchers at Purdue University create the ionizing effect with low voltage because the tips of the nanotubes are extremely narrow (about 5 nanometers wide) and the oppositely charged electrodes are spaced about 10 microns apart.

Figure 2:
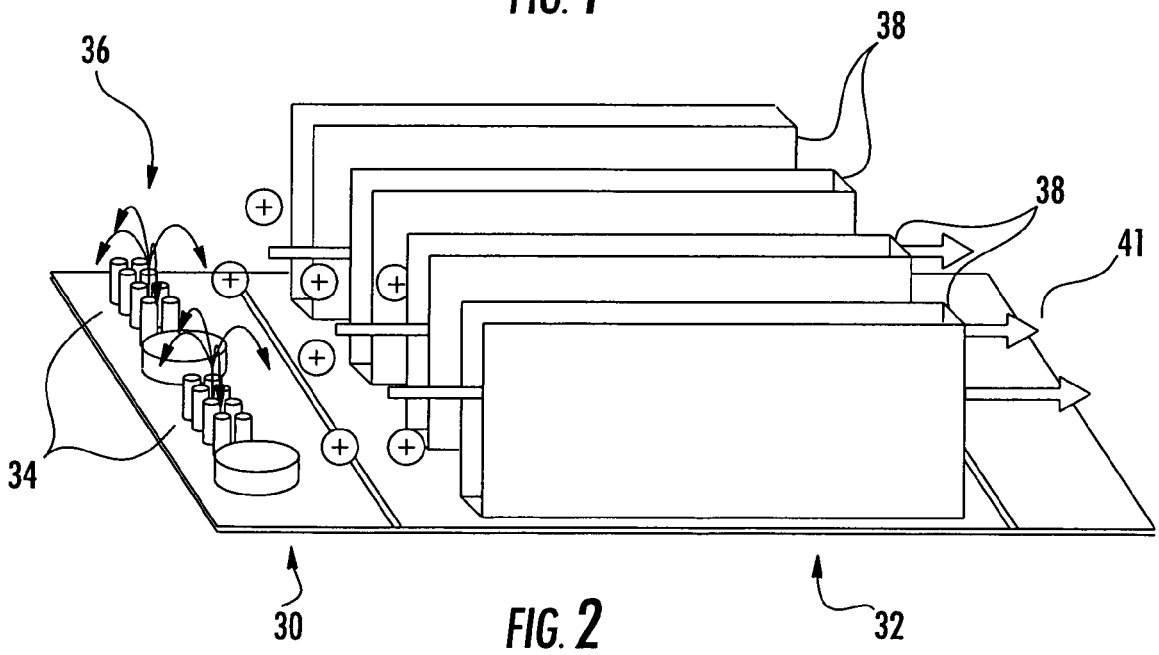
FIG. 2 is a detailed schematic diagram of the ionized air stream generator shown in FIG. 1.

The corona wind antenna 20 in accordance with the present invention is thus based upon the above ionized air generation technique to form an ionized air flow for use as an antenna. More particularly, the ionized air stream generator 22 comprises an ion generator 30 and a pumping region 32 carried by the housing 27 of the mobile communications device 26, as shown in FIG. 2. The ion generator 30 comprises a first set of electrodes 34 for generating ions 36. Clouds of ions are created when the electrons 36 react with air.

The pumping region 32 comprises a second set of electrodes 38 in the form of parallel plates or nanotubes. The clouds of ions are attracted by the second set of electrodes 38 and are "pumped" forward by changing the voltages in the second set of electrodes. The voltages are rapidly switched from one electrode to the next in such a way that the clouds of ions 36 move forward and produce an ionized air stream 41. As the ions move forward, they make repeated collisions with neutral molecules, producing the ionized air stream 41.

One approach of the pumping concept is to divide the second set of electrodes 36 into a series of electrodes, with each series containing three electrodes. The first electrode in the series is the most positively charged, followed by an electrode that has a less-positive charge and then a third electrode that is negatively charged. Switching the voltages from one electrode to the next causes the charges to move forward, which in turn moves the ion clouds.

Still referring to FIG. 1, a transceiver 52 is carried by the housing 27 and is coupled to the ionized air chamber 24. The transceiver 52 excites or detects changes in a current flow in the ionized air stream at radio communication frequencies. A modem 50 comprising a modulator and a demodulator is also between the ionized air chamber 24 and the transceiver 52.

The transceiver 52 provides a carrier frequency signal that is mixed in the modulator and demodulator. Alternatively, the transceiver 52 may not provide a carrier frequency signal. Instead, the baseband signal is appropriately filtered in the modulator but applied at the baseband data rate to the ionized air chamber 24. The demodulator likewise filters the receive signal to produce the received baseband signal.

Moreover, the communications module 54 may be configured to operate in a half duplex case, i.e., time division duplex. In this case, the demodulation is the same as shown in FIG. 1. In the half duplex case where the receive and transmit functions do not occur simultaneously, and the modulation is restricted to binary. The transmit baseband signal is used to turn on and off the ionized air stream generator 22. This may be accomplished by shutting off just the ion generator 30; shutting off just the pumping region 32; shutting off both the ion generator and the pumping region; and shutting off the ion generator or the pumping region plus reverse the direction of the voltage progression in the pumping region. This will cause a faster stoppage to the movement of the ions.

An amplifier 51 amplifies the transmit and receives signals. The amplifier 51, modem 50 and transceiver 52 are included within a communications module 54 that is coupled to the ionized air chamber 24. The coupling may be either inductive and/or capacitive, for example. Alternatively, the coupling may be by conductive contact.

In the illustrated example, the communications module 54 is capacitively coupled to the ionized air chamber 24 via a capacitor plate 60, and by varying a voltage applied to the ionized air chamber 24, the ionized air stream is modulated with a baseband signal as readily appreciated by those skilled in the art. A signal received by the ionized air stream may also be demodulated with the baseband signal being removed therefrom by the communications module 54. In sharp contrast to laser generated plasma antennas being modulated by the lasers, the modulation in the present invention is advantageously performed by varying the voltage applied to the ionized air stream.

Figure 3:
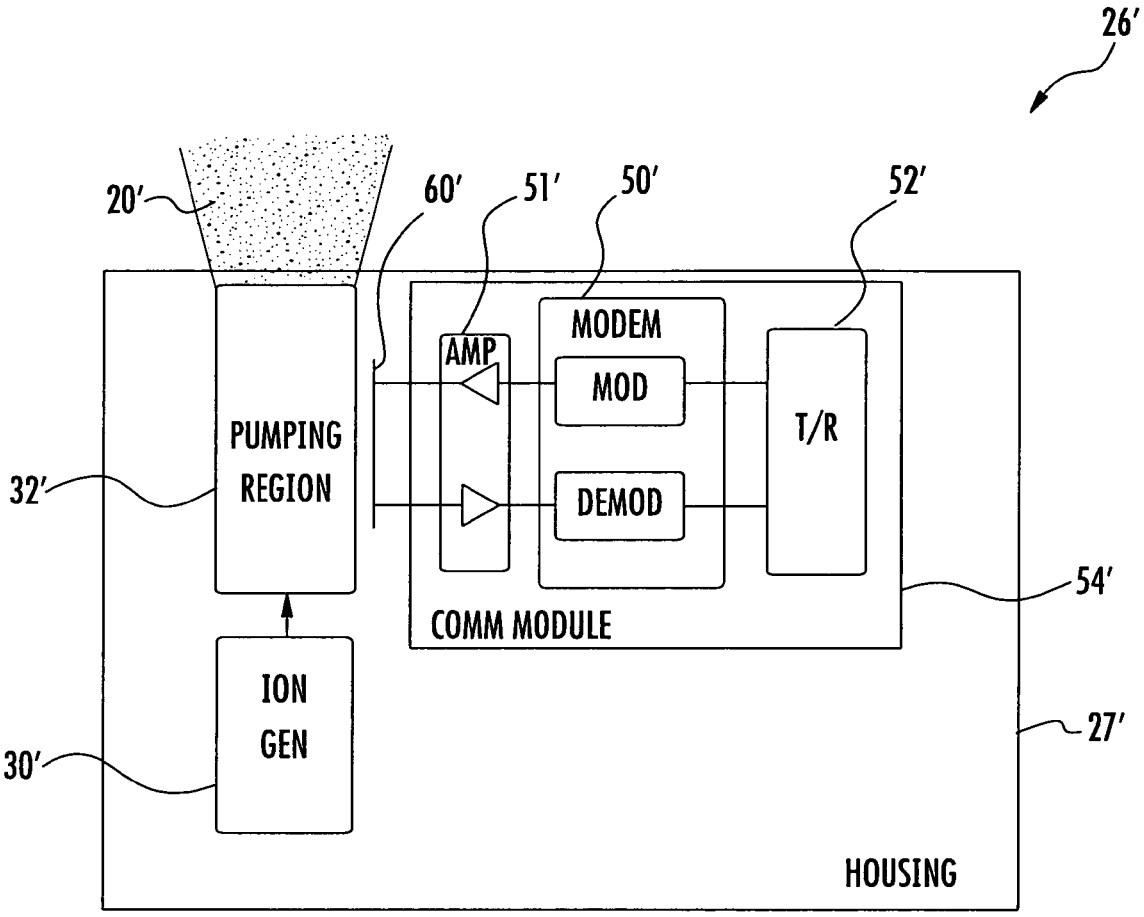
FIG. 3 is a block diagram another embodiment of the mobile communications device shown in FIG. 1 with the communications module coupled to the pumping region.

In another embodiment, the communications module 54 may be directly coupled to the pumping region 24 instead of to the ionized air chamber, as shown in FIG. 3. The ionized air stream exits the pumping region 32 and functions as the antenna 20.

For the ionized air stream to function as an antenna 20, the density thereof needs to be sufficient so that a varying voltage applied by the modulator 50 and transceiver 52 are sufficient to support communication exchanges. As an example, assume that the mobile communications device 26 has a maximum transmit power of 1 watt, with 0.7 watts being typical. It is also assumed that there is a 10 volt differential from the exit point of the antenna 20 to any point on the mobile communications device 26. In general, the exposure should not be greater than 42 volts, since this is the accepted standard for safety considerations. The current flow will therefore be in the range of 100 ma, which translates into 0.1 Coulombs/second. This is equal to $6.28\times10^{17}$ electrons/second or alternately positive ions/second.

While metal driven antenna systems are often around 80 to 90% efficient, the corona wind antenna is less, and is typically around 50%. The efficiency can be increased if the dissipation of the corona wind is minimized within the mobile communications device 26. The ionized air chamber 24 increases the efficiency by preventing dissipation of the corona wind before exiting the housing 27. Based upon an efficiency of 50 to 90%, the ion density of the corona wind antenna 20 is within a range of about $5\times10^{17}$ to $13\times10^{17}$ to ions/second.

Another embodiment of the mobile communications device 26" is to have a slightly extendable tube structure 25" that provides a partial solid implementation of the antenna 20", with the rest of the antenna being created by the ionized air stream. This approach keeps the solid structure reasonably short, while extending the effective length to a value suitable for the carrier frequency range.

The tube extension 25" can be pulled out by the user, or extended by the corona wind itself and retracted by gravity or a tensile retractor. The tube extension 25" may also be of a flexible nature which will be straightened out by the corona wind. In all cases, the material of the tube extension 25" may be RF conductive, and therefore suitable as a portion of the antenna itself. Alternatively, the tube extension 25" may be transparent to RF and the corona wind contained within is the antenna 20". The latter is preferable since it will result in no discontinuity in the impedance of the corona wind antenna 20" at the boundary with the corona only portion. While the corona wind portion of the antenna 20" is length dominant, the relationship between the tube extension 25" and the corona wind will be dictated by various factors, such as antenna wavelength, corona cohesion, ionic concentration decay, and environmental conditions, for example.

The channel the corona wind antenna operates in can be adjusted by changing the length of the ionized air stream. This can be done by changing the velocity, mass of air moved, and how these values are varied in time, as readily appreciated by those skilled in the art.

Given that the ionized air stream will be interacting with the surrounding air, there will be no sharp cut off in the ionization stream length. Rather, there will be a nominal effective length based on the air stream generation mechanism and characteristics. Adjustments in the length can be made dynamically based on the observed operational characteristics of the antenna locally (e.g., received signal and VSWR), and reported effectiveness from the remote equipment being communicated therewith. In some implementations and conditions, dithering the characteristics of the corona stream will serve as way to track changes that will influence the adjustments made.

More complicated antenna structures can also be formed by the use of multiple ionized air streams, as will be discussed in greater detail below. Patch type antennas can be created by allowing the ionized air streams to freely commingle and/or exit from the restricted to free air. Antenna arrays can be formed by ejecting streams from different positions on the communications devices (angular diversity, antenna diversity, MIMO) and in different orientations (polarization diversity). The ionized nature of the coronas tend to have them repulse each other, and commingling will occur where the coronas are weak and not functioning as effectively as antennas.

Figure 5:
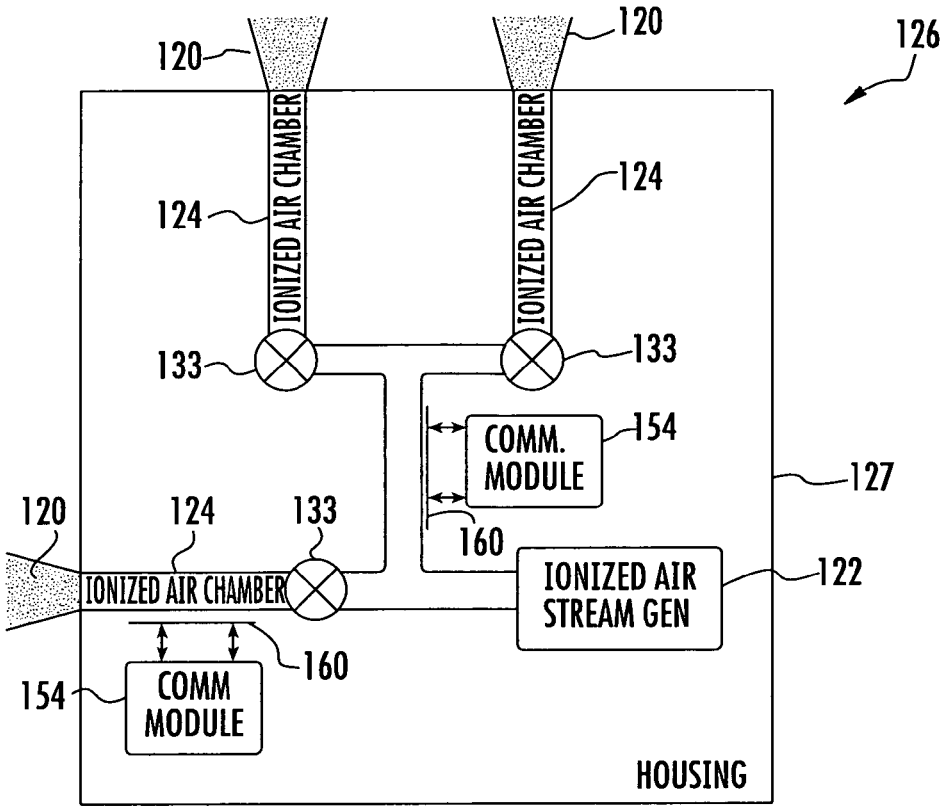
FIG. 5 is a block diagram a mobile communications device generating a plurality of corona wind antennas using a single ionized air stream generator in accordance with the present invention.
Figure 6A:
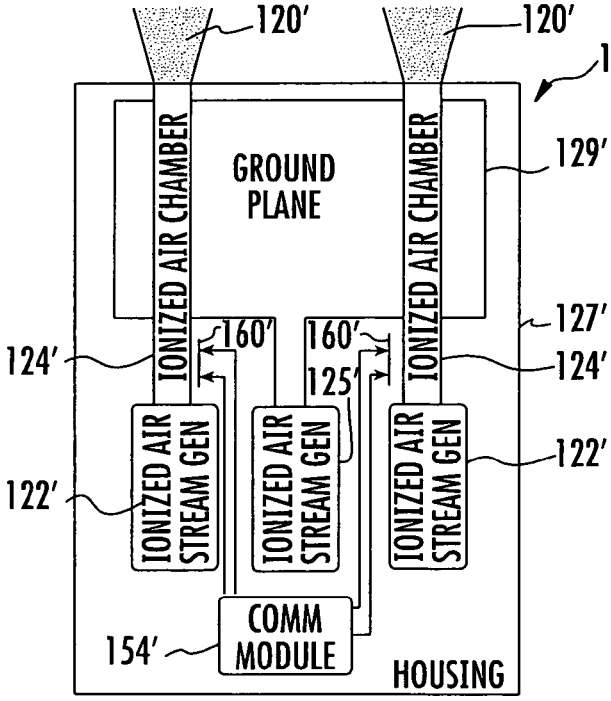
FIGS. 6*a* and 6*b* are block diagrams of a front view and a side view of another embodiment of a mobile communications device generating a plurality of corona wind antennas using more than one ionized air stream generator in accordance with the present invention.
Figure 6B:
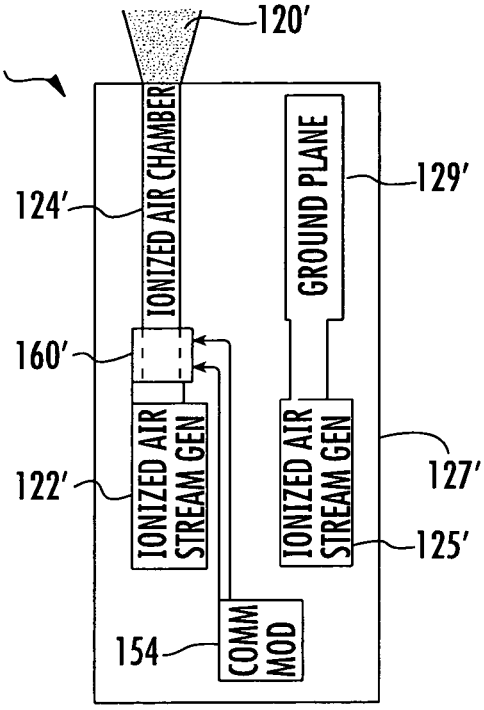

Referring now to FIGS. 5, 6*a* and 6*b*, the ionized air stream can be channeled through different paths and compartments within the housing 127, 127' of the communications devices 126, 126' to generate more than one antenna 120, 120' at a time. The generation of multiple antennas 120, 120' allows the antenna assembly to function as a smart antenna, as well as perform the other functions as noted above. The generated antennas 120, 120' may function as active antenna elements and passive antenna elements.

Flow switches are used to control the flow of the ionized air streams to modify the usage of the overall antennas. For instance, these changes may be for pattern modification, frequency response, gain variance and signal sensitivity.

The changes may be effected by modifying where the corona winds are generated by modifying the wind generator operations, and by changes along the paths of the wind. These controlling functions can be performed by electrical or by mechanical means 133 as best suited to the implementation. Microelectro-mechanical systems, which are often referred to as MEMS, are suitable for the direct mechanical control functions, such as path shut off or modulated flow control, and in some circumstances will also cause suitable electronic behavior modifications, such as surface exposure between air and the ion generators.

The ionized air stream from a single ionized air generator 122 may be split or directed to more than one ionized air chamber 124. Several channel flows are controlled by flow switches 133, as illustrated in FIG. 5. The two vertical channel flows may be used for spatial diversity, and the horizontal channel flow provides an alternate polarization, as readily appreciated by those skilled in the art. One or more communications modules 154 may be coupled to the ionized air chambers 124. In alternate embodiments, the communications modules 154 may be connected directly to the ionized air stream generator 122, or immediately to the output thereof.

The communications device 126' may include more than one ionized air stream generator 122', as illustrated in FIGS. 6*a* and 6*b*. Each ionized air chamber 124' has an ionized air stream generator 122' connected thereto for providing a respective ionized air streams. In some embodiments, a secondary ionized air stream generator 125' is carried by the housing 127' for generating a secondary ionized air stream. A secondary ionized air chamber 129' is carried by the housing 127' for receiving the secondary ionized air stream to function as a ground plane.

In other words, there are two narrow antenna elements 120' and a ground plane 129' for the illustrated communications device 126'. During transmission it might be suitable to use one antenna, while creating two during reception. The ground plane 129' may be useful in some circumstances, but is not necessary in others.

A combination of ionized air stream generators and control flow switches can be combined as suitable for various implementations. The ionized air parts of the antenna assembly may also be coupled to solid antenna elements. For instance the external element may be fully or partially implemented as a solid, while the paths and chambers containing the ionized air form the reconfigurable part of the antenna assembly.

The shapes taken by the antenna components may be very intricate and variable. They may also extend in the three physical dimensions. For purposes of simplifying the drawings, unionized air intakes are not shown. The air intakes could be specific channels to the outside ambient air, or openings in the ion generators using the air inside the device.

It may be desirable in some implementations to permanently surround some of the ionized air stream generators or ionized air chambers by conductive structures attached to static voltage sources to block their functioning as antenna components.

As noted above, it is preferable to have antennas external the communications device so that the device itself does not interfere with the transmitted or received electromagnetic radiation. Nonetheless, the corona wind antenna may be utilized internal the communications device.

Figure 4:
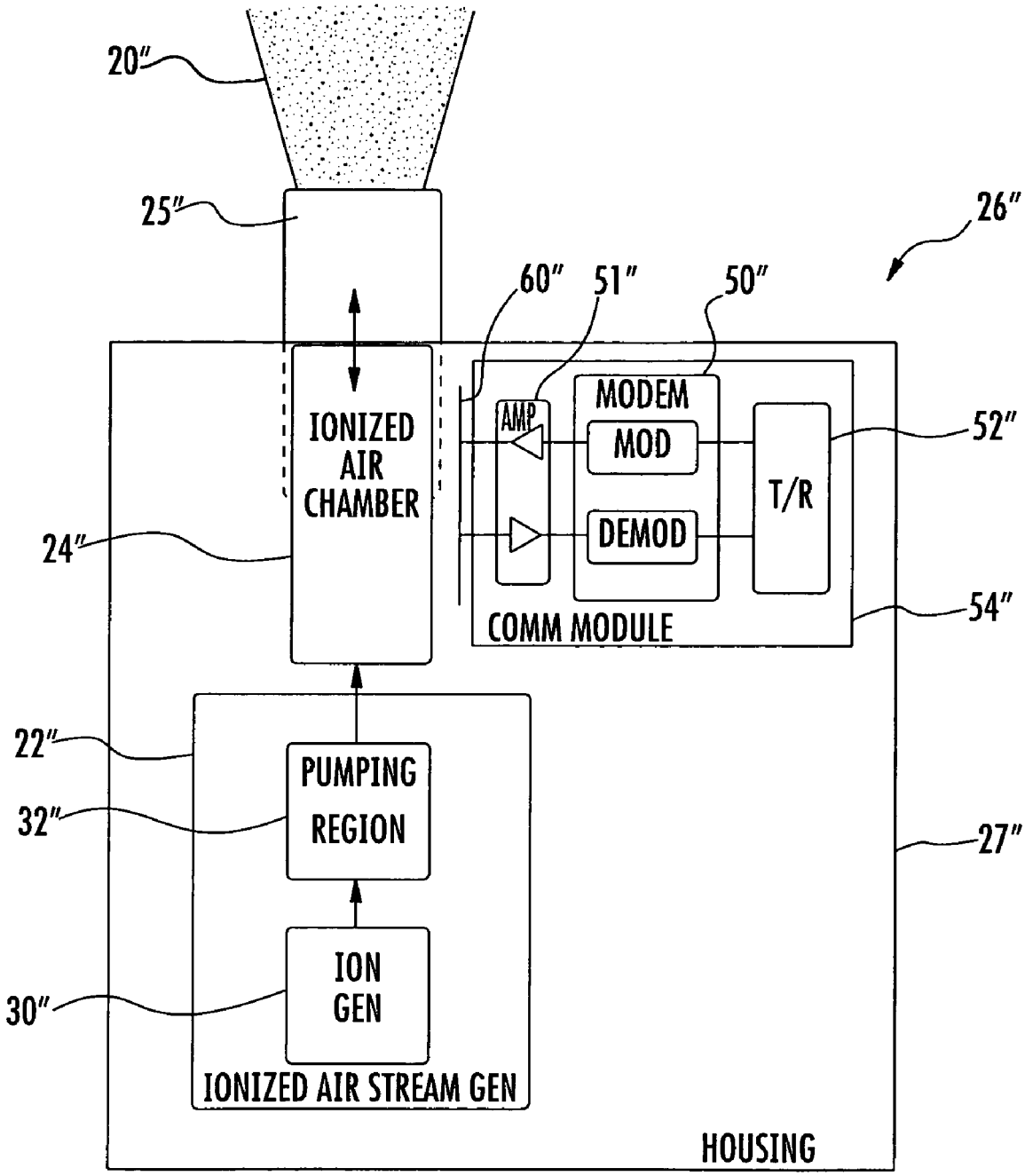
FIG. 4 is a block diagram of another embodiment of the mobile communications device shown in FIG. 1 with a tube extension for the corona wind antenna.

In the embodiments illustrated in FIGS. 1, 3 and 4, the ionized air stream is either unconstrained in dispersion or constrained only to a limited degree. The effective dimensions of the antenna are therefore wide compared to its length, which makes it suitable as a wideband traveling wave antenna. It is not however particularly effective as a narrow band antenna. Conversely, the channelized concept shown in FIGS. 5, 6*a* and 6*b* constrains the width of the ionized gas, but is embedded in the device. It is therefore suitable for narrow bands, but may have a blockage problem relative to RF propagation.

Figure 7:
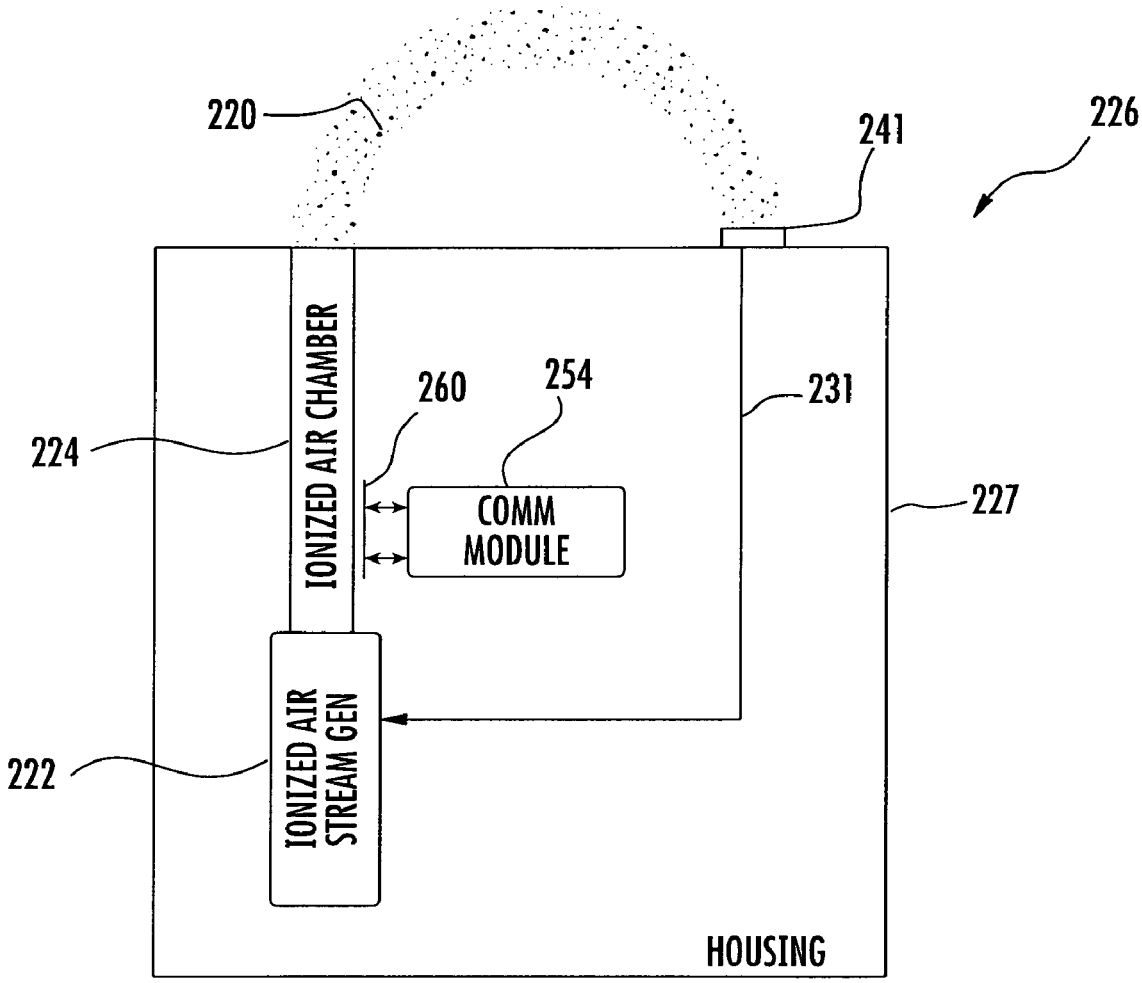
FIG. 7 is a block diagram a mobile communications device with a loop back corona wind antenna in accordance with the present invention.

To address this particular blockage problem, reference is directed to the communications device 226 illustrated in FIG. 7, which provides an external antenna that has a narrower width to length to support narrow bands. A conductive plate 241 is carried by the housing 227 along an outer edge thereof and is laterally spaced away from an exit point of the ionized air stream. The conductive plate 241 has a polarity opposite a polarity of the at least one ionized air stream for causing the ionized air stream to loop back to the conductive plate.

The loop back corona wind antenna 220 greatly lessens the dispersion of the effective antenna width, and makes it suitable for narrow band utilization. The conductive plate 241 is electrically connected to the ionized air stream generator 222.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A communications device comprising:

a housing;

at least one ionized air stream generator carried by said housing for generating at least one ionized air stream;

at least one ionized air chamber carried by said housing and having an exposed end for directing the at least one ionized air stream external said housing to function as an antenna;

an antenna tube extension carried by said housing and being slideably positioned to an extended position along the exposed end of said at least one ionized air chamber for extending a length of the antenna; and a transceiver carried by said housing and coupled to said at least one ionized air chamber.

2. A communications device according to claim 1 wherein said transceiver excites or detects changes in a current flow in the at least one ionized air stream at radio communication frequencies.

3. A communications device according to claim 1 further comprising a modulator and a demodulator carried by said housing between said at least one ionized air chamber and said transceiver.

4. A communications device according to claim 1 wherein said transceiver is at least one of capacitively and inductively coupled to said at least one ionized air chamber.

5. A communications device according to claim 1 wherein said at least one ionized air stream generator comprises:

an ion generator for generating ions; and a pumping region adjacent said ion generator for generating the at least one ionized air stream using the generated ions.

6. A communications device according to claim 1 wherein the at least one ionized air stream moves said antenna tube extension to the extended position.

7. A communications device according to claim 1 wherein said antenna tube extension is moved to the extended position by a user.

8. A communications device according to claim 1 wherein said at least one ionized air chamber comprises a plurality of ionized air chambers, with each ionized air chamber directing a respective ionized air stream external said housing for functioning as an antenna.

9. A communications device according to claim 8 wherein the respective ionized air streams are directed external said housing in different directions to provide polarization diversity.

10. A communications device according to claim 8 wherein the respective ionized air streams are directed external said housing in the same direction to provide spatial diversity.

11. A communications device according to claim 8 further comprising at least one flow switch in a path of at least one of said plurality of ionized air chambers for restricting flow of the ionized air stream to a desired ionized air chamber.

12. A communications device according to claim 1 further comprising a conductive plate carried by said housing along an outer edge thereof and being laterally spaced away from an exit point of the at least one ionized air stream;

said conductive plate having a polarity opposite a polarity of the at least one ionized air stream for causing the at least one ionized air stream to loop back to said conductive plate.

13. A communications device according to claim 12 wherein said conductive plate is electrically connected to said at least one ionized air stream generator.

14. A communications device according to claim 1 wherein said at least one ionized air stream generator comprises a plurality of ionized air stream generators; and wherein said at least one ionized air chamber comprises a respective ionized air chamber for each ionized stream generator.

15. A communications device according to claim 14 further comprising a secondary ionized air stream generator carried by said housing for generating a secondary ionized air stream; and a secondary ionized air chamber carried by said housing for receiving the secondary ionized air stream to function as a ground plane.

16. A communications device comprising:

a housing;

an ion generator carried by said housing for generating ions; and a pumping region carried by said housing and adjacent said ion generator for generating an ionized air stream using the generated ions, said pumping region directing the ionized air stream external said housing to function as an antenna;

a conductive plate carried by said housing along an outer edge thereof and being laterally spaced away from an exit point of the ionized air stream, said conductive plate having a polarity opposite a polarity of the ionized air stream for causing the ionized air stream to loop back to said conductive plate; and a transceiver carried by said housing and coupled to said pumping region.

17. A communications device according to claim 16 wherein said transceiver excites or detects changes in a current flow in the ionized air stream at radio communication frequencies.

18. A communications device according to claim 16 wherein said transceiver is at least one of capacitively and inductively coupled to said pumping region.

19. A communications device according to claim 16 wherein said conductive plate is electrically connected to said ion generator.

20. A communications device according to claim 17 wherein the ionized air stream has a density within a range of about $5\times10^{17}$ to $13\times10^{17}$ ions/second.

21. An antenna assembly comprising:

at least one ionized air stream generator for generating a plurality of air streams, and comprising an ion generator for generating ions, and a pumping region adacent said ion generator for generating the plurality of ionized air streams using the generated ions; and a plurality of ionized air chambers for directing the plurality of ionized air streams external thereto so that the plurality of ionized air streams function as respective antennas.

22. An antenna assembly according to claim 21 wherein each ionized air chamber has an exposed end for directing a respective ionized air stream external thereto; and further comprising a respective antenna tube extension that is slideably positioned to an extended position along the exposed end of a corresponding ionized air chamber for extending a length of the antenna.

23. An antenna assembly according to claim 22 wherein each ionized air stream moves a corresponding antenna tube extension to the extended position.

24. An antenna assembly according to claim 22 wherein each antenna tube extension is moved to the extended position by a user.

25. An antenna assembly according to claim 21 wherein the respective ionized air streams are directed in different directions to provide polarization diversity.

26. An antenna assembly according to claim 21 wherein the respective ionized air streams are directed in the same direction to provide spatial diversity.

27. An antenna assembly according to claim 21 further comprising at least one flow switch in a path of said plurality of ionized air chambers for restricting flow of the ionized air streams to desired ionized air chambers.

28. An antenna assembly according to claim 21 wherein said at least one ionized air stream generator comprises a plurality of ionized air stream generators, with each ionized air stream generator corresponding to a respective ionized air chamber.

29. An antenna assembly according to claim 28 further comprising a secondary ionized air stream generator for generating a secondary ionized air stream; and a secondary ionized air chamber for receiving the secondary ionized air stream to function as a ground plane.

30. A method for generating an antenna for a communications device comprising a housing, at least one ionized air stream generator carried by the housing and having an exposed end, an antenna tube extension carried by said housing and at least one ionized air chamber carried by the housing, the method comprising:

generating at least one ionized air stream by the at least one ionized air stream generator; and directing through the at least one ionized air chamber the at least one ionized air stream so that it is external the housing to function as an antenna; and slideably positioning the antenna tube extension to an extended position along the exposed end of the at least one ionized air chamber for extending a length of the antenna.

31. A method according to claim 30 wherein the communications device further comprises a transceiver carried by the housing and coupled to the at least one ionized air chamber, said transceiver exciting or detecting changes in a current flow in the at least one ionized air stream at radio communication frequencies.

32. A method according to claim 30 wherein the transceiver is at least one of capacitively and inductively coupled to the at least one ionized air chamber.

33. A method according to claim 30 wherein the at least one ionized air stream generator comprises an ion generator for generating ions; and a pumping region adjacent the ion generator for generating the at least one ionized air stream using the generated ions.

34. A method according to claim 30 wherein the at least one ionized air chamber comprises a plurality of ionized air chambers, with each ionized air chamber directing a respective ionized air stream external the housing for functioning as an antenna.

35. A method according to claim 34 wherein the communications device further comprises at least one flow switch in a path of at least one of the plurality of ionized air chambers for restricting flow of the ionized air stream to a desired ionized air chamber.

36. A method according to claim 30 wherein the communications device further comprises a conductive plate carried by the housing along an outer edge thereof and being laterally spaced away from an exit point of the at least one ionized air stream; the conductive plate having a polarity opposite a polarity of the at least one ionized air stream for causing the at least one ionized air stream to loop back to the conductive plate.

37. A method according to claim 30 wherein the at least one ionized air stream generator comprises a plurality of ionized air stream generators; and wherein the at least one ionized air chamber comprises a respective ionized air chamber for each ionized stream generator.

* * * * *

UNITED STATES PATENT AND TRADEMARK OFFICE

CERTIFICATE OF CORRECTION

PATENT NO. : 7,482,981 B2
APPLICATION NO. : 11/191315
DATED : January 27, 2009
INVENTOR(S) : Goldberg et al.

It is certified that error appears in the above-identified patent and that said Letters Patent is hereby corrected as shown below:

| | |
|---|---|
| Column 3, Line 38 | Delete: "diagram another"<br>Insert: -- diagram of another -- |
| Column 3, Line 44 | Delete: "diagram a"<br>Insert: -- diagram of a -- |
| Column 3, Line 53 | Delete: "diagram a"<br>Insert: -- diagram of a -- |
| Column 6, Line 11 | Delete: "to ions/second."<br>Insert: -- ions/second. -- |

Signed and Sealed this

Seventh Day of April, 2009

John Doll

JOHN DOLL
*Acting Director of the United States Patent and Trademark Office*